US006125648A

United States Patent [19]

Hill

[11] Patent Number: 6,125,648

[45] Date of Patent: Oct. 3, 2000

[54] MULTI-RISER REFRIGERATION SYSTEM WITH OIL RETURN MEANS

[76] Inventor: Herbert L. Hill, 1022 Leawood, St. Louis, Mo. 63126

[21] Appl. No.: 09/215,822

[22] Filed: Dec. 18, 1998

Related U.S. Application Data

[63] Continuation-in-part of application No. 08/949,183, Oct. 10, 1997, Pat. No. 5,875,640.

[51] Int. Cl.[7] ..... F25B 43/02; F25B 39/02

[52] U.S. Cl. ..... 62/471; 62/84; 62/524

[58] Field of Search ..... 62/471, 472, 84, 62/193, 524

[56] References Cited

U.S. PATENT DOCUMENTS 3,257,824 6/1966 Shikasho ..... 62/471 X 4,625,523 12/1986 Toub et al. ..... 62/471 X 4,715,196 12/1987 Sugiura ..... 62/471 X

*Primary Examiner*—William Wayner

*Attorney, Agent, or Firm*—Daniel Kramer

[57] ABSTRACT

A refrigeration system having compressors positioned higher than the dispersed evaporators requires multiple suction risers. To better ensure oil return to the compressors, only a single oil return riser is employed. This oil return riser is connected to one end of an oil collection main positioned near the lower portion of the suction risers. The oil collection main is connected by restricted oil drain conduits to the lower portions of the suction risers, thereby collecting the oil which failed to be conveyed to the top of the suction risers by their vapor velocity. The restrictions in the oil drain conduits ensure adequate vapor velocity within the oil collection main even with widely varying loads on the suction risers.

20 Claims, 4 Drawing Sheets

MULTI-RISER REFRIGERATION SYSTEM WITH OIL RETURN MEANS

CROSS REFERENCE TO RELATED APPLICATION: Continuation-in-Part

This is a continuation-in-part of patent application Ser. No. 08/949,183 filed Oct. 10, 1997, now U.S. Pat. No. 5,875,640 by the same inventor.

FIELD OF THE INVENTION

The present invention relates to air conditioning and refrigeration systems with individually controlled evaporators positioned at levels lower than the compressor level. More particularly the invention is directed toward systems having two or more suction risers connected at their tops to a main suction conduit with an oil collection main positioned at or near the bottom of the suction risers and connected to each by an oil return conduit. The oil collection main is connected at one end to a single oil return riser whose top is connected to the main suction conduit. The invention is further directed to valve means in the main suction conduit for providing pressure drop sufficient to ensure adequate vapor flow up the oil return riser to ensure oil flow up the riser and to restriction means in the oil return conduits connecting the suction risers with the oil collection main to ensure proper vapor velocity through the oil collection main under various load conditions in the suction risers.

BACKGROUND OF THE INVENTION

Including Discussion of Prior Art

It is well known, that in compression type refrigerating and air-conditioning systems, the compressors employed for compressing the vaporous refrigerant employ oil or lubricant to lubricate their internal parts. In the course of drawing in refrigerant vapor, compressing and discharging the vapor to condensers, some of the lubricating oil is entrained with and discharged with the compressed vapor. Though means for removing some of the oil from the discharge stream are sometimes employed, a small quantity of oil always fails to be removed, traversing such means, and is conveyed with the compressed refrigerant through the condenser and cooling coil or evaporator. The oil leaving the evaporator and entering the suction line must have a way to return to the compressor. Failure to provide such a way can result in accumulation of oil within the refrigerating tubes and pipes and progressive loss of oil from the compressor. It is not uncommon in poorly designed systems for so much oil to be lost from the compressor that insufficient oil is left to properly lubricate and cool the compressor, thereby causing the compressor to fail.

Wherever the compressor is at the same level or lower than the evaporator, oil flow through the vapor return conduit from evaporator to compressor (suction line) is aided by the velocity of vapor flowing through the suction line and by gravity, and the oil returns satisfactorily to the compressor. Even when the compressor is located higher than the evaporator, satisfactory oil return can be simply secured by proper sizing of the upflowing suction line (suction riser) to provide adequate vapor velocity to assure oil return.

However, the compressor-overhead situation is severely complicated when there are several evaporators at various levels below the compressor and the evaporators operate on independent schedules so that the refrigerating loads and therefore the gas velocities through the suction riser vary widely.

One of several strategies found in piping manuals is employed now to cope with this situation. One strategy employs so-called dual risers, where a large and a small riser are coupled together at their bottom and an oil trap is employed to stop flow through the large riser, thereby maintaining satisfactory vapor velocities through the small riser to assure oil return. This arrangement works satisfactorily when the range of loads is small, typically 4:1.

Under this parallel condition the vapor velocity in both must be sufficient to cause oil to flow up the risers. Naturally, great precision and engineering skill is required to properly size the risers and traps. Further, where the loads vary widely, over a range of 10 to 1 or more, such dual riser systems fail to work and oil accumulates in the risers and is lost from the compressor/s. This situation is further complicated and worsened where there are multiple compressors which operate under independent control so that even a single small compressor may run while still requiring satisfactory oil return.

A serious draw back of the dual riser arrangement is that the oil trap removes oils that may be needed for compressor lubrication. When the pressure drop through the small riser becomes so great that it blows out the oil trap, then both risers function together in parallel. Under these blow-out conditions the mass of oil accumulated in the trap may be carried back to the compressor in a slug when the load suddenly increases, thereby raising the possibility of compressor damage from the mass of incompressible oil entering its cylinders.

A further drawback of the dual riser piping arrangement is the difficulty of correctly matching the limited number of pipe or tube sizes available to the required limited range of vapor velocities needed to ensure oil flow up the riser.

A second strategy simply requires that each evaporator have its own suction riser, sized for proper return of oil when the evaporator is operating. This option increases the number of pipes and joints required, thereby increasing the cost of piping and increasing the probability of leaks at the increased number of joint.

Where loads vary very widely and a unitary riser system is desirable, engineers have employed, as a third strategy, oil accumulators are positioned at the bottom of the risers to collect oil which fails to be returned up the riser at conditions of low load and corresponding low suction vapor velocities. This arrangement requires the use of pressure pumps to force the oil collected in the oil accumulator back to the compressor/s through small pipes provided for the purpose. An oil float valve positioned in each compressor crankcase opens when the oil level drops below a predetermined level, thereby causing the oil quantity in that crankcase to be replenished.

The oil return problem is made even more complex where evaporators are so positioned below the compressors that multiple suction risers are required. In that case multiple dual risers may be required further complicating both the engineering and the physical problems and therefore the cost of piping the installation. Where a suction riser, having loads at several levels, is sized for proper oil return with minimum pressure drop, the upper portions of the riser may have a greater diameter than the lower portions. Should one or more the upper loads decrease or drop to zero because its refrigerating or air-conditioning load has been satisfied, oil may rise with the suction vapor in the lower portions of the riser but, because of the decreased load and vapor velocity in the larger upper portions, may fail to rise or be entrained through the upper portions of the riser. Therefore the oil may collect or "log" in the upper portion, thereby causing an oil shortage in the compressor.

The present invention is directed to solving this last problem in a simple manner, without oil pumps and without critical pipe sizing, all while ensuring proper oil return to the compressor over an extremely wide range of full load to minimum load ratios.

SUMMARY OF THE INVENTION

A refrigeration system employing paralleled suction risers having evaporators connected thereto, said risers being connected at their tops to a main suction conduit, an oil collection conduit positioned beneath the suction risers, an oil return riser connected at its lower portion to the oil collection conduit and at its upper portion to the main suction conduit, a pressure differential valve positioned in the suction main for maintaining a minimum pressure drop across the oil return riser to ensure oil flow up the oil return riser, the oil collection conduit being connected to the lower portion of the suction risers by more or less restricted conduits, whereby vapor flow sufficient to cause oil flow in the oil collection conduit is maintained.

BRIEF DESCRIPTION OF THE DRAWINGS

The foregoing summary as well as the following description of preferred embodiments of the invention, will be better understood when read in conjunction with the appended drawings. For the purpose of illustrating the invention there are shown in the drawings embodiments which are presently preferred, it being understood, however, that the invention is not limited to the specific instrumentalities or the precise arrangement of elements disclosed.

DETAILED DESCRIPTION OF THE INVENTION

Figure 1:
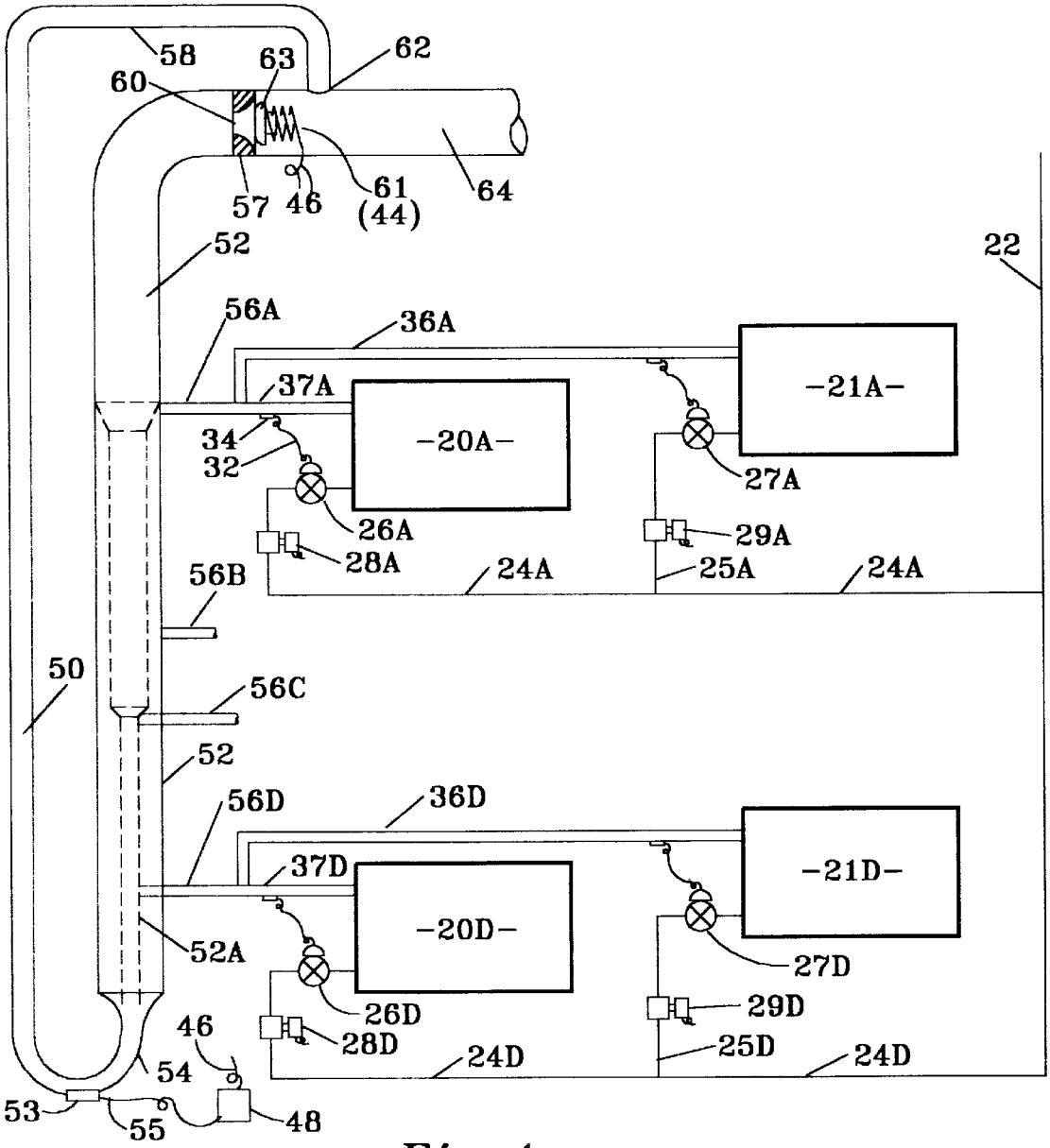
FIG. 1 is an elevational view of a schematic diagram of an embodiment of the invention claimed in the related application showing a large and a small suction riser with a pressure relief valve positioned at the top of the large riser and with evaporators at several levels.

Referring now to the drawings, wherein like references are used to indicate like elements, there is shown in FIG. 1 an elevational piping diagram of an embodiment of the present invention. In the description of the functioning of the elements of FIG. 1, reference to the structure of FIG. 2 may be made periodically, since it is intended that the structures of FIG. 1 and FIG. 2 apply to the same refrigerating system.

Referring again to the structure of FIG. 1, there are shown four levels of evaporators. The elements comprising each level are identified by letters A, B, C and D. For instance, there is shown an evaporator 20A at the most elevated level and a similar evaporator 20D at the lowest level. At each level there are shown an evaporator 20 and a different evaporator 21. These evaporators may be the same sizes or different sizes. Though all the evaporators are identified by the numerals 20 or 21, there is no suggestion implied or suggested by such numbering that the similarly numbered evaporators are the same or the same size or have the same function. In fact all the evaporators may be of different sizes and have different functions. For instance, one may cool air for comfort conditioning, another may cool water for drinking purposes, a third may chill water for circulation in a chilled water air-conditioning system, a fourth may provide condensing for a water cooled icemaker and a fifth may be a freezer evaporator which employs an intermediate compressor, not shown, discharging into a suction branch 36 or 37.

Figure 2:
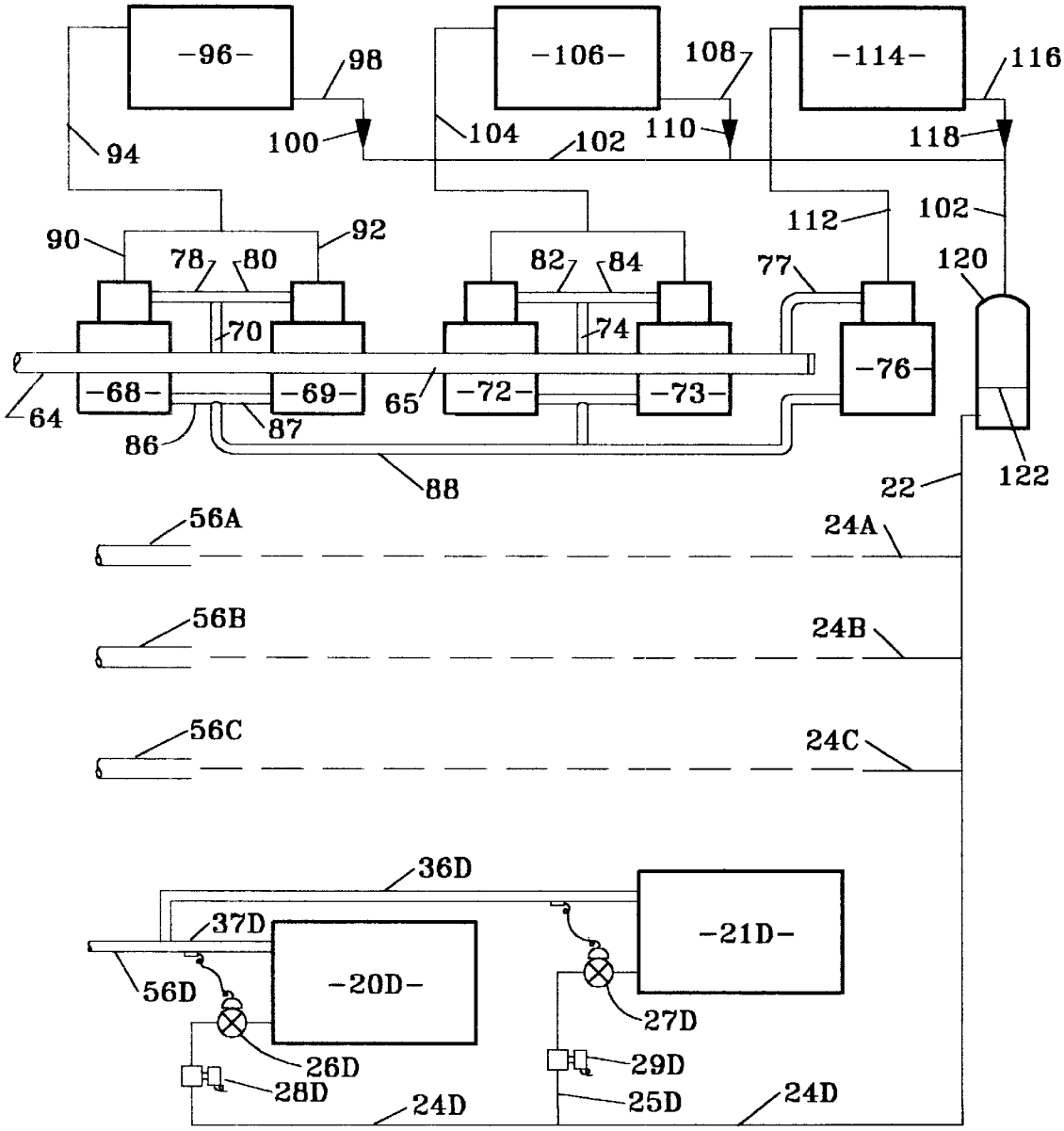
FIG. 2 shows a schematic piping diagram, applicable both to the invention claimed in the related application and the invention claimed herein, of a multiple compressor arrangement with paired compressors and multiple condensers, each compressor pair connected to an independent air cooled condenser, the condenser outlets connected in parallel.

All evaporators 20 and 21 are fed from a main liquid line 22 whose liquid source is receiver 122 shown in FIG. 2. The liquid supply to each level is by way of branch liquid line 24. Evaporator 20A is illustrated having expansion valve 26A positioned to receive liquid refrigerant from branch liquid line 24A. The operation of expansion valve 26A is governed by temperature sensing bulb 34 which is mounted in thermal contact with the suction outlet 37A of evaporator 20A and is connected by capillary tube 32 to the expansion valve 26A. Flow to the expansion valve 26A is allowed or prevented by solenoid valve 28A. Though corresponding valves and controls are shown for each of the evaporators 20A, 21A, 20D and 21D, it must be understood that the principles of the invention are not related to the type of liquid refrigerant control or to the nature of the evaporator employed.

At each level the suction outlet conduits 36 and 37 are joined and their combined flow is delivered to suction riser 52 by way of combined suction conduit 56. Though only two evaporators are shown at each level, it must be understood that the principle of the invention does not depend on the number of evaporators at each level or whether their suction outlets are combined into a single suction conduit 56 or in -an alternate construction are directed to and connected to large suction riser 52 by individual connections. In an alternate construction riser 52 has a smaller diameter at its lower end, a larger diameter at its upper end and an intermediate diameter in the middle. This construction is displayed as a dashed line 52A within riser 52.

Substantially adjacent to larger riser 52 is smaller riser 50 which is connected to larger riser 52 at the bottom of each with a round or rectangular U-shaped bent conduit 54 having substantially the same diameter as riser 50. The tops of the smaller riser 50 and the larger riser 52 are joined at point 62 positioned on the outlet side of pressure differential valve 57.

Suction riser 52 has installed at its uppermost level a pressure differential or pressure relief valve 57 having port 60, closing element or piston 63 and piston biasing spring 61. The biasing spring 61 provides sufficient force to retain piston 63 in its closed condition until the pressure at its left or inlet side rises to a predetermined value higher than the pressure at its right or outlet side. This pressure difference or pressure differential is reflected by an equal or greater pressure drop across small riser 50. The selection or setting of spring 61 is made to ensure that sufficient pressure drop across the small riser 50 exists at all times that any portion of the whole system is in operation. By providing such a minimum pressure drop across small riser 50 there is guaranteed sufficient vapor velocity up riser 50 for reliable oil entrainment and oil flow up riser 50 for return to the compressor/s.

Tests and experience have shown that oil is carried up the walls of a pipe by the friction exerted on it by the gas flowing in the pipe. These tests have indicated that a unit pressure drop not less than 0.005 psi/ft of vertical riser is sufficient to return oil up risers regardless of the refrigerant or pipe size. While the 0.005 psi/ft represents a minimum, it is usual to risers to be sized for higher unit pressure drops both to relieve the designer of any anxiety about the success of her piping design and to minimize the cost of the piping. Therefore, the following examples will be based on higher unit pressure drops.

For example, if relief valve 57 was absent and large riser 52 was unrestricted, the operation of the system with a minimum load would generate such low vapor velocities through the parallel risers 50/52 that oil would not be entrained with the vapor in either riser and would collect at the bottom of the risers in trap 54. If there were a hand valve substituted for relief valve 57 and the hand valve were closed, all the vapor from any and all evaporators operating would have to traverse the small riser 50. The combined flow from the evaporators would ensure adequate oil return but the pressure drop through the small riser 50 would be excessive whenever the load exceeded the design load for the small riser.

By contrast, with pressure relief valve 57 installed as shown in FIG. 1, the relief valve 57 would remain closed as more load from more operational evaporators came "on line" until the pressure drop across small riser 50 exceeded the setting of relief valve 57. At that time relief valve 57 would throttle open as the load increased, retaining a substantially constant pressure drop across itself and therefore across small riser 50.

During the initial stages of opening of relief valve 57 the upward velocity of the vapor in large riser 52 would be insufficient to carry oil upward with the vapor flow since most of the vapor flow in larger riser 52 would be in a downward direction toward and into U-bend/trap 54 followed by flow upward within small riser 50. Therefore the oil deposited in large riser 52 would flow downward into trap 54 where it would be entrained and carried up riser 50 by the higher velocity vapor flowing in riser 50. The entrained oil having been carried up small riser 50 would then be deposited in large suction conduit 64 at the point 62 where the small riser 50 joins the larger riser 52. At that point the larger conduit is horizontal and the oil would flow readily back to the compressor even with low vapor velocities present.

When sufficient load arising from the operation of many evaporators or large evaporators connected near the bottom of larger riser 52 causes sufficiently high vapor velocities over the full length of larger riser 52 for oil to be entrained with the vapor, at that time most of the oil will cease flowing downward in larger riser 52. However, some of the vapor and oil flowing into larger riser 52 from the evaporators will always have a downward direction of flow toward and through U-bend 54 and then upward through smaller riser 50. Further, should the evaporators be connected to the larger suction riser 52 at various levels, as shown in FIG. 1, an intermediate condition may arise where the oil entering the large riser 52 with the suction vapor of the upper evaporators may encounter sufficiently high velocities to be entrained with the refrigerant vapor and flow upward in riser 52 to and through relief or differential valve 57, while, simultaneously, near the bottom of the large riser 52 there will be downward flow of vapor and oil into and through U-Bend 54 then upward through small riser 50. Note that within the smaller diameter U bend 54 and riser 50 the refrigerant vapor velocity is raised to a sufficiently high velocity, by the minimum pressure drop across it created and controlled by pressure differential valve 57, to ensure flow of both the vapor and the oil flowing with the vapor up riser 50 to its top 58 and thereafter into main suction conduit 64.

The following example describes the operation of the oil return system embodying risers 50 and 52 when employed with a vapor compression refrigeration system for air-conditioning employing HCFC-22 (monochloro-difluoro methane) refrigerant. The suction pressure, that is, the pressure of the refrigerant vapor in the risers is 68 psig corresponding to a saturated refrigerant temperature of 40F. The smallest evaporator connected to the riser system has a capacity of 5.0 TR (tons refrigeration) or 60,000 Btu/hr. The total system capacity arising when all the evaporators are in operation is 115 TR or 1,380,000 Btu/hr.

Since the riser system, embodying the invention, has the capability of providing proper oil return to the compressor under the full range of capacities from 5 TR to 115 TR, the operation of the riser system will be examined at four loads, 5 TR, the minimum load, 20 TR, 70 TR and 115 TR, the maximum load. The operation of the riser system at these four loads will duplicate the riser performance at all intermediate loads.

Suction riser 50 has an internal diameter which is selected to provide sufficient refrigerant vapor velocity to entrain or otherwise provide flow conditions within the riser at the minimum expected load of 5 TR. Such a minimum load would arise under the condition where only a single evaporator, such as evaporator 20D, is refrigerating; that is, is supplied with liquid refrigerant from its branch liquid conduit 24D to its expansion valve 26D by a person or control having energized liquid solenoid 28D in order to provide flow of liquid refrigerant to expansion valve 26D and thereby to evaporator 20D.

The correct range of tube, line, riser or conduit sizes 50 for oil entrainment up a vertical riser at the specific minimum load of 5 TR is found by reference to the 1994 Refrigeration Handbook published by the American Society of Heating, Refrigerating and Air-Conditioning Engineers (ASHRAE) at Table 13 on page 12 in chapter 2. This chart sets forth the minimum load at which each tube size will return oil up a vertical riser. For instance at a suction pressure corresponding to 40F (40F suction) it specifies that 1 1⅛ line have a minimum 1.46 TR load. A 1⅜ line, a 2.46 TR load and a 1⅝ line a 3.81 TR load. Assuming that we have established that we do not wish to tolerate a pressure drop in the suction risers of more than 3 psi which corresponds to about 2F change in the corresponding suction temperature, we could select any of the above three tube sizes. However, before we decide we must calculate the pressure drop the 100 ft. tube will exhibit at a full 5 TR load.

Calculation shows that the 1⅛ tube will have only 2.2 psi pressure drop at a 5 TR load and it is this size we will select for small riser 50. On the assumption that the entire 110 TR load is connected to the large riser at its bottom, the condition which would arise if all evaporators were installed near the bottom of riser 52 or otherwise connected at 56D, we select large riser 52 in the same way. We find that a 100 ft. long 3⅛ riser which requires at least a 20.4 TR load for oil return will have a 100 ft. pressure drop of 3.9 psi with 110 TR load. The next larger tube size, 3⅝ diameter, requires a minimum load of 29.7 TR for oil return. This 3⅝ tube size will, over a 100 ft. length, have a pressure drop at 110 TR of 1.93 psi, which is less than our 3 psi maximum limiting pressure drop in the risers.

Note that a still larger riser 54 could be employed in expectation of a later capacity addition since pressure differential valve 57 would assure sufficient pressure drop across small riser 50 to ensure oil return under all conditions.

If however the loads are spaced as shown in FIG. 1, then riser 52 could employ smaller diameters at the lower end between trap 54 and connection 56C, intermediate diameters at the middle between 56C and 56A and the largest diameters above connection 56A. This arrangement is shown in dashed lines 52A within the riser 52 in FIG. 1. If the larger 3⅛ diameter tube was employed for riser 52, the pressure drop would be substantially lower than the 2.2 psi recited above where the entire maximum/variable load was connected at or near the bottom of the large riser. The exact total pressure drop would depend on the load input at each of the levels A,B,C and D, if these are known, and could easily be calculated employing the tables referred to above.

Having selected the appropriate tube sizes for the large riser 52 and the small riser 50, we shall now investigate the oil flow regimes we can expect at the various loads between 5 TR and 115 TR.

With the minimum load of 5 TR, relief valve 57 sees only a 2.22 psi pressure drop across it. Since it is set to open only when it sees a pressure drop across it greater than 3.0 psi, by adjustment or selection of spring 61, relief valve 57 will remain closed. With valve 57 closed, wherever the 5 TR load is connected to large riser 52, the total vapor flow will be downward. Oil return in a vertical riser with downward flow will occur at any, even the lowest, vapor velocity. Therefore, oil which enters riser 52 along with the vapor from the 5 TR load will flow down to trap 54 and be entrained with the up-flowing vapor in riser 50. The oil flow upward in riser 50 will occur because the 5 TR load is greater than the 1.46 TR minimum load established as minimum by the ASHRAE tables.

At the next load increment chosen for illustration purposes, the total load will be 20 TR. As the load has increased from 5 TR to 20 TR, all the suction vapor has attempted to flow up small riser 50. However, at a load of 5.9 TR the pressure drop in small riser 50 rises to 3 psi. This 3 psi pressure drop across small riser 50 is reflected in the same pressure drop across pressure relief valve 57. At that pressure drop pressure relief valve 57 begins to open. It opens just enough to maintain a 3 psi pressure drop across itself, thereby assuring that a 3.0 psi pressure drop is simultaneously maintained across small riser 50. So long as the 3 psi pressure drop is maintained across small riser 50, the flow upward through that small riser will remain at 5.9 TR, far exceeding the minimum flow rate of 1.46 TR required for oil return. The remainder of the 20 TR load of (20–5.9) or 14.1 TR will flow upward through large riser 52.

Since the minimum load in large riser 52 to accomplish oil return is 29.7 TR, there will not be sufficient vapor velocity to carry oil up riser 52. Therefore, while there will be 14.1 TR of vapor flowing up large riser 52, the oil accompanying the vapor will not be transported upward through larger riser 52. Instead, the oil will flow downward to trap 54, in a direction opposite to the vapor flow in the large riser, at the same time that the 14.1 TR of vapor is flowing upward in the large riser 52. The oil reaching the trap 54 along with the vapor downflow of 5.9 TR will be entrained with the 5.9 TR of vapor flowing therein and will be carried up small riser 50 with the 5.9 TR of vapor. The 5.9 TR of vapor flowing upward in smaller riser 50 will eventually reach junction 62 with suction manifold 64 and empty into it thereby joining and merging with whatever vapor and oil has flowed upward through larger riser 54 and pressure differential valve 57.

At the next stage of load of 70 TR, selected for description of the operation of the novel riser system, relief valve 57 will open wider to accommodate an upward vapor flow of (70–5.9)=64.1 TR. This rate of vapor flow exceeds the minimum flow rate of 29.7 TR required for upward oil flow in the 3⅝ in dia. large riser 52. Therefore, at least some of the oil entering riser 52 with the 70 TR vapor load will flow upward with the 64.1 TR upward vapor flow while the remainder will flow downward into U-bend 54 with any accompanying oil and thence upward through small riser 50.

If all 70 TR of vapor loading does not enter large riser 52 at one point, such as point A or B, etc., but is distributed over the height of riser 52, at the lower portions of larger riser 52 there may be loads smaller than the minimum vapor flow of 29.7 TR required for upward oil flow. For instance, if only 10 TR load enters riser 52 at level D and 10 TR at level C and 5 TR at level B, there will be a range of vapor velocities from 10 TR to 25 TR flowing in large riser 52 below level A. None of these velocities are sufficient to maintain upward oil flow in large riser 52. Therefore, all the oil entering with these loads at levels D, C and B will flow downward to trap 54 along with the 5.9 TR vapor flow necessary to maintain the 3 psi pressure drop in riser 50, necessary to open and keep open pressure differential valve 57. The 5.9 TR vapor and accompanying oil will be returned to the suction main 64 by virtue of its upward flow through small riser 50.

However, when the remainder of loads totaling 70 TR enter riser 52 at any level, the vapor velocities with the riser at and above that level will exceed the minimum of 29.7 TR required for upward oil flow while below that level, oil will flow downward to trap 54 as described above.

With the full load of 115 TR applied to large riser 52, there will again be likely to be a range of vapor velocities within riser 52. Wherever the vapor velocity is less than the 29.7 TR load, oil will flow downward to trap 54, wherever it is greater than 29.7 TR, the oil will be entrained with the refrigerant vapor and flow upward, through relief valve 57 and into suction manifold, there to combine with whatever oil and vapor has entered trap 54 and flowed upward through small riser 50 to join at junction 62 with suction manifold 64. However, at all times there will be a 5.9 TR downward vapor flow through the bottom portion of larger riser 52, into U-Bend 54 and then up through smaller riser 50.

In an alternate construction, also represented by the construction displayed in FIG. 1, there is provided an oil sensor 53 positioned at or near the bottom of trap 54. The output of oil sensor 53 is conveyed via communicating element 55 to controller 48. The communicating element 55 is a wire, but in an alternate construction it is a tube. Controller 48 reacts to the presence of oil which has collected at the bottom of trap 54 and has affected sensor 53 by sending a signal to biasing coil 44 at pressure relief valve 57. In this alternate construction, the position of closing element or piston 63 of pressure relief valve 57 is determined by biasing coil 44. When oil sensor 55 detects the presence of an accumulation of oil in trap 54 and sends the appropriate signal to controller 48, the controller 48 reacts by causing biasing coil 44 to move piston or closing element 63 in a direction which tends to close port 60 of pressure relief valve 57. Controller 48 is a time biased device which acts to gradually increase the closing bias of biasing coil 44 on piston 63 until oil sensor 55 signals that it no longer detects oil present in trap 54.

Oil sensor 53 may be any one of numerous types available to detect the presence of liquid in a gaseous environment. One such type is a float actuating a switch. A second is a light source-light detector combination; a third is an index of refraction sensor. Other types which detect the presence of oil in a gas environment are also suitable.

While complex and more costly than the simple pressure relief valve described above, where biasing spring 61 maintains riser 52 closed until the load has sufficiently increased, the alternate construction employing oil sensor 53 has the advantage of allowing free flow through both riser 50 and 52, without any pressure drop penalty imposed by relief valve 60, until failure of the risers to return oil is evidenced by collection of unreturned oil in trap 54. Only then will the piston or closing element 63 of pressure relief valve 57 be caused to restrict flow through port 60 of valve 57, thereby causing an increase of pressure drop and a resultant increase of flow through small riser 50, until unreturned oil collected in trap 54 is entrained by the increased gas velocity generated by the partial (or total) closure of valve 57. At that time, when unreturned oil has been entrained and returned, sensor 53 will detect no oil residing in trap 54. At that time it will signal controller 48 to cause bias coil 44 to move piston 63 in a direction to cause port 60 to open or become less restrictive, thereby reducing overall suction line pressure drop and increasing system efficiency.

Referring now to FIG. 2 there is shown a group of five compressors, 68, 69, 72, 73 and 76. The compressors are arranged in two pairs, a first pair 68,69 and a second pair 72,73, and a single compressor 76. Though the compressors are shown to be the same size, it is not intended that their capacities necessarily be the same. In fact large and small compressors having large and small capacities could be coupled together since compressor size is not pertinent to explanation of the operation of this phase of the invention.

Each group of compressors of FIG. 2 employs an independent condenser element. Compressor pair 68 and 69 employs condenser element 96. Compressor pair 72 and 73 employs condenser element 106 and single compressor 76 employs condenser element 114. Though each condenser element is shown as an independent free standing unit, it is intended that the disclosed piping arrangement apply equally well to a large single condenser having three or more independent circuit elements or to two or more individual condensers connected together to act as a single element. While two compressors are shown connected to each condenser element, any number of compressors may be assigned to each condenser or condenser group.

There is a common suction manifold 64/65 which receives suction vapor from the evaporators 20D and 21D and from other evaporators, not shown, by way of the suction risers 50 and 52. These risers and their connection to the evaporators are shown in FIG. 1. The suction risers of FIG. 1 discharge their vapor into suction manifold 64, shown both in FIGS. 1 and 2.

Suction manifold 64 provides refrigerant vapor to all the compressors. Compressor pair 68 and 69 receive suction vapor from suction manifold 64 by way of branch connection 70. Branch connection 70 splits into two suction inlets, 78 for compressor 68 and 80 for compressor 69.

In exactly similar fashion, compressors 72 and 73 receive suction vapor from suction manifold 64 by way of branch suction line 74 and suction inlet conduits 82 and 84.

Single compressor 76 receives its supply of suction vapor by way of suction inlet connection 77 which is connected to suction manifold 64.

The hot compressed refrigerant vapor from compressor 68 is discharged into its discharge conduit 90. Likewise, the hot compressed refrigerant vapor from compressor 69 is discharged into its discharge conduit 92. The flow from two discharge conduits 90 and 92 are combined into a main discharge conduit 94. This main discharge conduit 94 delivers the compressor hot refrigerant vapor to condenser element 96. Though condenser element 96 is shown as a single element, it may be constructed of two or more separate elements or unitary condensers coupled together.

In exactly similar fashion the discharge conduits of compressors 72 and 73 are combined into main discharge conduit 104. Discharge conduit 104 supplies compressed vapor to condenser element 106. Compressor 76 discharges its hot compressed vapor into discharge conduit 112 which delivers the compressed vapor to the condenser element 114.

While it is intended that each compressor operate independently of the other compressors, there is established an operating protocol which calls for the single compressor 76 to start first to supply the lowest load. The lowest load arises when a liquid solenoid valve such as 28D is called on to open by its temperature or other control. As the demand for cooling increases, more and more of the compressors are called on to turn on. The sequential control of the compressors is by way of suction pressure switches set to monitor the pressure in suction manifold 64 and adjusted to turn each compressor on in sequence when the suction pressure rises above a preset value. Other sequencing means are widely available and the details of such schemes do not form a part of this invention.

Condenser 96 acts to condense the hot compressed refrigerant vapor delivered to it by discharge conduit 94, to a hot liquid refrigerant. The hot liquid refrigerant flows out of condenser element 96 through condenser outlet or liquid conduit 98. Check valve 100 is installed in condenser outlet conduit 98 to allow flow away from the condenser but to prevent reverse flow back to the condenser. The liquid discharged from condenser 96 flows through check valve 100 and into liquid main 102.

Each condenser element has a liquid outlet conduit connected to deliver the hot liquid it has condensed into liquid main 102.

In each liquid outlet conduit there is installed a check valve to allow flow from the condenser into the liquid main 102 and to prevent reverse flow. For example, condenser element 106 employs check valve 110 in its condenser outlet conduit 108 and condenser 114 has check valve 118 positioned in its liquid outlet conduit 116. The liquid outlet conduits from all the condenser elements connect to liquid main 102 through the check valves positioned to allow flow from the condenser outlet and to prevent reverse from the liquid main 102 back into any condenser connected to it.

The collected liquid from all the condensers, flowing in liquid main conduit 102, flows to receiver tank 120. Receiver 120 is simply a pressure vessel designed to hold a reserve supply of liquid refrigerant until such stored liquid refrigerant is required by an evaporator. The liquid refrigerant stored in receiver 120 has a liquid level 122, much the same as any body of liquid stored in a tank would have such a level. Then liquid stored in receiver 120 flows into liquid line 22, as required by any evaporator whose cooling effect is required by the opening of a liquid solenoid 29 associated with it.

Continuing reference to FIG. 2, the pressure in any condenser depends on the amount of vapor delivered to it by its related compressor or compressors and by the temperature of the air or other coolant used to remove the heat of condensation from the hot compressed refrigerant vapor. Since at different times each condenser may have different internal pressures, flow from a condenser into the main liquid conduit 102 cannot occur until the pressure in that condenser is equal to or slightly above the pressure of the liquid in liquid main 102. Whenever a compressor is delivering hot compressed vapor to a condenser, yet the pressure in that condenser is lower than the pressure in the liquid main 102, flow from the condenser to the main cannot occur. Therefore while vapor continues to be delivered to the condenser and while the condensed liquid cannot leave the condenser, the liquid continues to collect in the condenser, thereby reducing the internal surface area available for condensing and consequently raising the internal pressure within the condenser. Only when enough liquid refrigerant has collected with the condenser for the pressure therein to equal the pressure in liquid main 102, will liquid refrigerant flow from the condenser into liquid main 102.

There will be many times, under conditions when the demand for refrigeration is slight, that all the compressors connected to deliver compressed vapor to a single condenser element may be inoperative. In that state the pressure within the condenser may drop to a value far below the pressure in liquid main 102. In all those cases, the check valve associated with that condenser will close, thereby preventing any refrigerant from flowing backward from liquid main 102 into the condenser associated with the inoperative compressors. For example, if both compressors 68 and 69 are off, then check valve 100 will close and prevent liquid refrigerant present in liquid main 102 from flowing backward through condenser outlet conduit 98 back into condenser 96. Under certain conditions it is likely that such back flow, if allowed, would deplete the charge of refrigerant in receiver 120 and leave an inadequate supply for delivery into liquid line 22 from receiver 120.

By virtue of the disclosed condenser piping arrangement it should be apparent that, with respect to any single condenser only two conditions can exist. In one condition where all compressors feeding a single condenser element are off there is no flow through the condenser. Therefore there will be zero pressure drop through the condenser, but there will be no liquid or oil to be transported. In the other condition there is flow generated by no less than 50% of the design load. That flow is more than sufficient to achieve the minimum flow rate and pressure drop for satisfactory operation.

The compressors are all interconnected by oil equalizer conduits 86, 87 and 88 in order to ensure adequate supply of lubricant to each.

Figure 3:
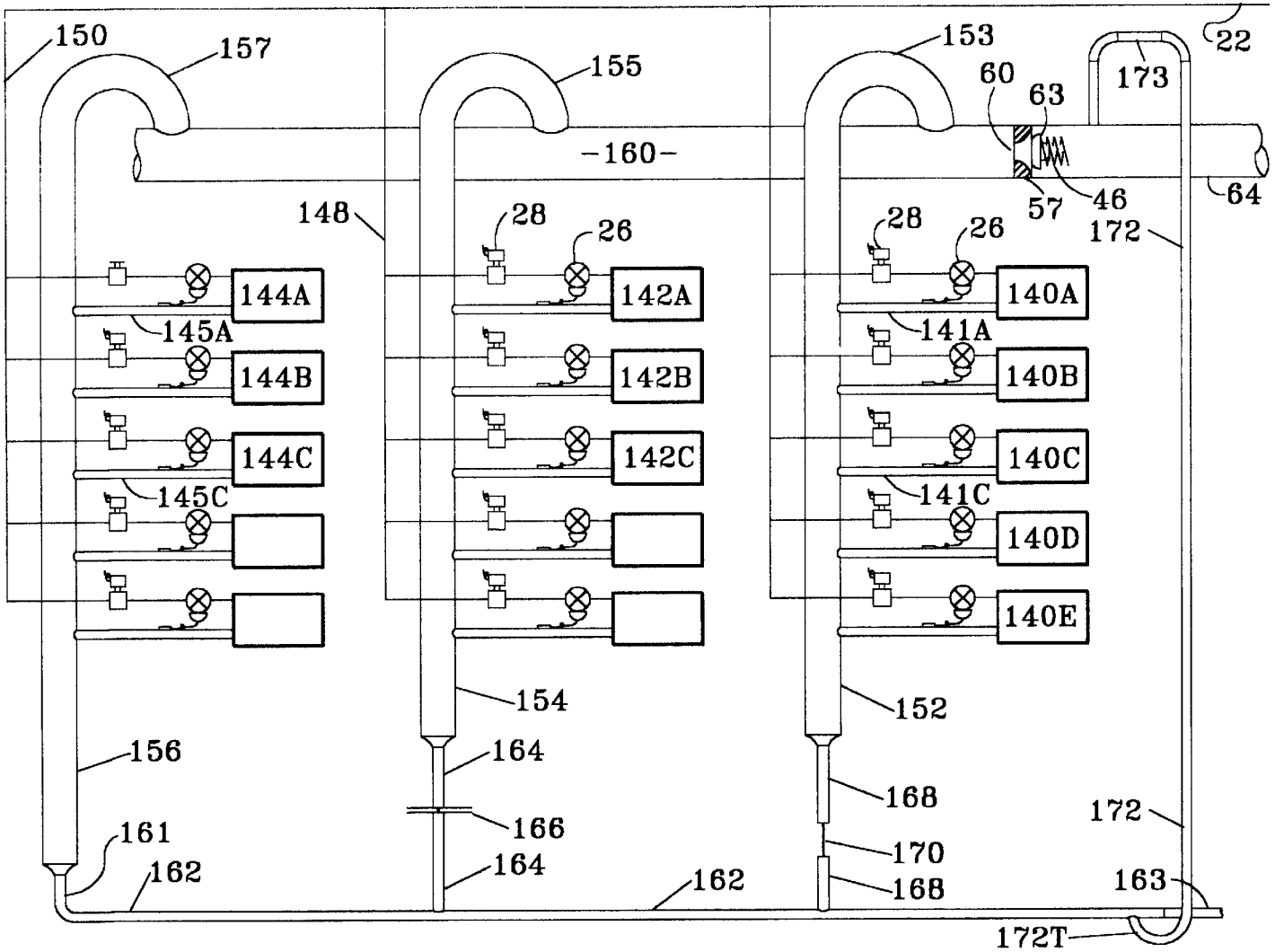
FIG. 3 illustrates piping directed to the claimed invention. The figure shows multiple suction risers, an oil collection conduit connected to a single oil return riser and more or less restricted conduits conning the lower portion of the suction risers with the oil collection conduit.

Referring now to FIG. 3, suction main 64 is a continuation of the same suction main 64 in FIG. 2. In FIG. 3 liquid line 22 also is a continuation of liquid line 22 in FIG. 2.

FIG. 3 discloses three sets of evaporators, 140(A,B,C,D, E), 142(A,B,E . . . ) AND 144(A,B,C . . . ). Each set of evaporators is so positioned within an application that it would be inconvenient to pipe each individual suction line 141A,B,C; 143A,B,C; and 145A,B,C to a single suction riser, all as described in connection with FIG. 1.

Therefore, each group of evaporators 140, 142 and 144 have their suction lines 141, 143 and 145 respectively piped to individual suction risers. The 140 group of evaporators is connected to suction riser 152; the 142 set of evaporators is connected to suction riser 154 and the 144 group of evaporators is connected to suction riser 156. The upper end of each suction riser is piped into a suction main 160. Within suction main 160 there is installed pressure differential check valve 57,63,46. The outlet of pressure reducing valve 57 is connected to suction main 64. Suction main 64 operates at a pressure that is lower than the pressure in suction main 160 by the amount of pressure differential introduced by check valve 57. As described in connection with FIG. 1, this pressure differential is adjusted to be sufficient to provide sufficient vapor velocity to return oil up an oil return riser. Examining the flow condition in suction riser 152, the vapor velocity will be highest near the top of the riser, providing all the evaporators are operative. At the upper levels of the riser 152 the velocity is likely to be sufficiently high for oil carried into the riser along with vapor from the upper evaporators, will be entrained with the higher velocity suction vapor and carried through goose-neck 153 into suction main 160. Goose-neck 153 is provided to prevent oil and liquid refrigerant, when present in suction main 160, from draining down suction riser 152. However, under conditions where only one or a few of evaporators 140 are in operation, the vapor velocity in suction riser 152 may be so low that oil will not be entrained with the vapor and therefore, instead of flowing up into suction main 160, will drain to the bottom of suction riser 152.

In order to avoid the engineering and pipe sizing complexity, and the cost of providing a separate oil return riser for each suction riser, an oil collection main 162 is provided. While oil collection main 162 is shown positioned below every portion of the suction risers, in some cases a portion of one or more risers may lay at the same level or even lower than oil collection main 162.

In order to provide means for conveying oil which has not been entrained with upflowing suction vapor and instead flows down to the lower portion of each suction riser, a conduit, described later, is provided to convey such unentrained oil from the lower portion of each suction riser to the oil collection main 162.

One end of the oil collection main 162 is connected to an oil return riser 172. The upper end of the oil return riser 172 is connected to suction main 64, the lower pressure portion of the suction main 160. Therefore, a pressure differential is introduced across the oil return riser 172 that is sufficient to create vapor flow at a sufficiently high velocity to entrain and carry to the top of oil return riser 172 all the oil collected by oil collection main 160 and to deposit this oil into suction main 64 for return to the compressors, thereby allowing their continued fully lubricated operation.

Now examining oil and vapor flow within oil collection main 162, while not obvious, an unintended logging or non flow of oil within the oil collection main may occur of all the conduits connecting the lower portion of the suction risers were full size, the same diameter as the conduit 162 connecting the lower portion of furthest riser 156 to the oil collection main. In that case, were suction riser 152 fully loaded by operation of all its evaporator 140, and were suction riser 154 and 156 slightly loaded, then there would be insufficient vapor flow from the furthest riser 156 through oil return main 162, to effectively assure oil flow through oil collection main 162.

In order to assure sufficient vapor velocity throughout the length of oil collection main 162, some of the oil drain conduits 164 and 168, which serve to convey oil from the lower portion of each suction riser 154 and 152 respectively to the oil collection main 162, must be restricted. That is they must be formed of successively smaller diameter tubing the closer the suction riser is to the oil return riser, or restrictions such as small diameter tube or even orifices must be provided. Therefore, the lower portion of furthest suction riser 156 is connected to the oil collection main by a larger or full size conduit 162. The next closest suction riser 154 has its lower portion connected to oil collection main 162 by conduit 164 within which is located an orifice 166 which provides a restriction of value X. The suction riser which returns oil to the oil collection main 162 at a point that is closest to oil return riser 172 is connected to the oil collection main 162 by conduit 168 within which is positioned a restrictor tube having a restriction of value Y. The relative degree of restriction of the conduits returning oil from the lower portions of the suction risers to the oil collection mains being related to the closeness of the oil return conduits connection in the oil collection main to the point of connection of the oil return riser 172 to the oil collection main. The closer the point of connection, the higher the degree of restriction in the oil return conduit (162, 164, 168). It is unimportant whether the restriction be in the form of a longer or shorter tube of smaller diameter or merely in a change in diameter of a restriction tube of equal length, or whether an orifice is employed as a restriction in some or all of the oil return conduits.

With this construction it is seen that oil return capability from the lower portion of each suction riser is allowed while, simultaneously, providing for substantially full vapor flow through the oil collection main 162 and up the oil return riser 172. However, if oil collection main 162 is very long, it could be larger in diameter than the oil return riser 172 to reduce pressure drop therein. In an extended system, additional suction risers may be connected to an oil collection main 163 extended beyond oil return riser 172.

Figure 4:
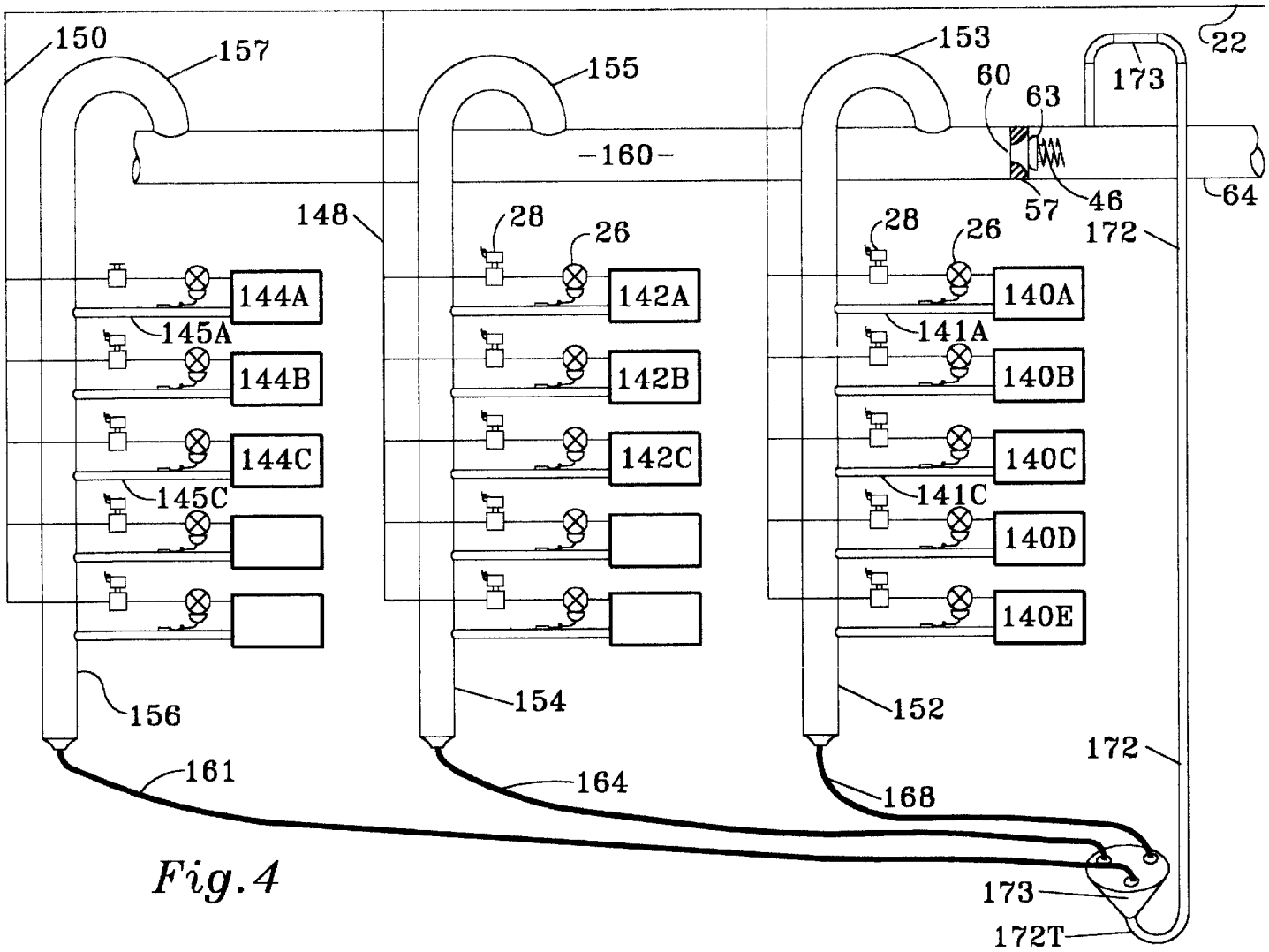
FIG. 4 shows multiple suction risers connected to a single oil return riser through substantially unrestricted oil return conduits and a central oil collection manifold feeding dirctly into the oil return riser.

Now referring to FIG. 4, there is shown a modification of the present invention in which no graduated restriction of the oil drain conduits is required. In FIG. 4, like FIG. 3, each suction riser 152, 154 156 is provided with an oil return conduit 168, 164 and 161 respectively. However, an oil collection manifold 173 is provided instead of the oil collection main 162 of FIG. 3. The oil return conduits connecting the lower portion of each suction riser are extended to and connected directly with the oil collection manifold 173. At the bottom of suction riser 156 there is connected one end of oil return conduit 161. The other end of oil return conduit 161 is connected to oil collection manifold 173. In like manner the bottom of suction riser 154 is connected to oil collection manifold 173 via oil return conduit 164. Similarly suction riser 152 has connected at its lower portion one end of oil return conduit 168, the other end of which is connected also to oil collection manifold 173. Since oil flow from the oil collection manifold 173 to the oil return riser 172 via trap 172T occurs by gravity, there is no issue of vapor velocity differential within the oil return manifold which might require apportioning vapor flow by way of restrictions in the oil return conduits 161, 164 and 168. Therefore the oil return conduits may all have diameters which are substantially equal and together sufficient to supply adequate vapor velocity up the oil return riser 172 to return the oil collected within oil collection manifold 173.

In order to better ensure adequate vapor velocity up oil return riser 172, pressure reducing valve 57, 60 is provided as explained above.

While the FIG. 4 displays the physical arrangement of the suction risers 152, 154 and 156 in a linear or planar arrangement, it should be noted that suction manifold 160 can have any shape. That is, the route described by suction manifold 160 can be circular, rectangular or any other shape. Oil return riser 172 can be located centrally so that the oil return conduits 161, 164 and 168 have substantially equal length in that case, or offset, as shown in FIG. 4 so that the lengths of the oil return conduits 161, 164, 168 are unequal. Further, suction main 160 can have branches into which other risers, than those shown in the figures, can be connected. While a perfectly symmetrical oil collection manifold 173 is shown for simplicity, oil collection manifold 173 can have any shape consistent with the requirement that oil returned to it be able to flow, without substantial interference or reliance on vapor velocity, to oil return riser 172 or its equivalent.

From the foregoing description, it can be seen that the present invention comprises an improved refrigeration system having widely variable capacity yet suitable for application in apartment buildings or other high rise structures, especially where the compressors are located above the bulk of the evaporators. It will be appreciated by those skilled in the art that changes could be made to the embodiments described in the foregoing description without departing from the broad inventive concept thereof. It is understood, therefore, that this invention is not limited to the particular embodiment or embodiments disclosed, but is intended to cover all modifications which are within the scope and spirit of the invention as defined by the appended claims.

I claim:

1. In a refrigerating system having multiple suction risers connected to a suction main at a higher level, an oil return riser delivering oil from a lower level to the suction main, an oil collection main positioned at a lower level, the oil return riser being connected to a first point in the oil collection main, oil return conduits connecting a lower portion of each suction riser to the oil collection main at oil return points, each oil return point being a distance from the first point, and a flow restriction having a restrictive value positioned within an oil return conduit.

2. A refrigerating system as recited in claim 1, further providing that the restrictive value of the flow restriction is greater, the shorter the distance from the oil return point to the first point.

3. A refrigerating system as recited in claim 1 further providing that the restrictive value of a flow restriction within an oil return conduit decreases as the distance between its point of connection to the oil collection conduit and the first point increases.

4. A refrigerating system, as defined in claim 2 where the type of restriction within an oil return conduit is selected from the group consisting of: orifices of varying diameters, tubes of varying lengths and tubes of varying diameters.

5. A refrigerating system as recited in claim 1 further providing a pressure reducing valve positioned in the suction main between the point of connection of a suction riser and the point of connection of the oil return riser.

6. A refrigerating system having a compressor positioned at an upper level, a suction main connected to the compressor, the suction main having upstream positions and downstream positions, the downstream positions having shorter flow distances to the compressor than the upstream positions, multiple suction risers each having a connection to an upstream position in the suction main, an oil collection main positioned at a lower level, an oil return riser connected to a point in the oil collection main for conveying oil from the oil collection main to a downstream position in the suction main, an oil return conduit connecting each riser to the oil collection main at a point which is a distance from the oil return riser, and a flow restriction positioned within an oil return conduit.

7. A refrigerating system as recited in claim 6 further providing that the restrictive value of the flow restriction is related to the distance.

8. A refrigerating system as recited in claim 7 further providing that the value of the flow restriction is inversely related to the distance.

9. A refrigerating system, as defined in claim 8 where the restriction type is selected from the group consisting of: orifices of varying diameters, tubes of varying lengths and tubes of varying diameters.

10. A refrigerating system as recited in claim 8 further providing a pressure reducing valve positioned in the suction main between the upstream positions and the downstream positions.

11. In a refrigerating system having a suction main at a higher level and multiple suction risers each having an upper portion and a lower portion and each having a connection between its upper portion and the suction main at a point, an oil collection main positioned at a lower level, an oil return riser connected to a point in the oil collection main for conveying oil from the oil collection main to a point in the suction main, an oil return conduit connecting a lower portion of each riser to the oil collection main, and a flow restriction having a restrictive value, positioned within an oil return conduit.

12. A refrigerating system as described in claim 11 further providing that the point of connection of each oil return conduit is a distance from the oil return riser and the restrictive value is a function of said distance.

13. A refrigerating system as described in claim 12 further providing that a pressure drop producing device is positioned in the suction main between the point of connection of the oil return riser and a point of connection of a suction riser.

14. In a compression type refrigeration system, a compressor, a suction main connected to the compressor, a plurality of suction risers connected to the suction main at points, oil collection means for receiving oil from the lower portion of each suction riser, oil return conduits connecting the lower portion of the suction risers to the oil collection means, and single riser for returning the collected oil from the oil collection means to the suction main at a point downstream from the points of connection of the suction risers.

15. A refrigeration system as recited in claim 14 further providing a pressure drop producing device positioned in the suction main between the points of connection of the suction risers and the point of connection of the oil return riser and the compressor.

16. A refrigerating system having a compressor positioned at an upper level, a suction main connected to the compressor, the suction main having upstream positions and downstream positions, the downstream positions having shorter flow distances to the compressor than the upstream positions, multiple suction risers each having a connection to an upstream position in the suction main, an oil return riser for returning oil to the suction main at a downstream position, oil collection means for conveying oil to the oil return riser and an oil return conduit connecting each riser to the oil collection means.

17. A refrigerating system as recited in claim 16 further providing a pressure reducing device positioned in the suction main between the upstream positions and the downstream positions.

18. A refrigerating system as recited in claim 17 where the oil collection means is a conduit and each oil return conduit is connected to the oil collection conduit at a different distance from the oil return riser at a point which is a distance from the oil return riser and a flow restriction positioned within an oil return conduit.

19. A refrigerating system as recited in claim 18 further providing that the restrictive value of the flow restriction is related to the distance.

20. A refrigerating system as recited in claim 19 further providing that the value of the flow restriction is inversely related to the distance.

* * * * *